US007404669B2

(12) United States Patent
Lambert

(10) Patent No.: US 7,404,669 B2
(45) Date of Patent: Jul. 29, 2008

(54) CLOCKWORK MOVEMENT

(75) Inventor: Bruno Marie Marc Lambert, Dommartin (FR)

(73) Assignee: Montblac-Simplo GmbH, Hamburg (DE)

( * ) Notice: Subject to any disclaimer, the term of this patent is extended or adjusted under 35 U.S.C. 154(b) by 100 days.

(21) Appl. No.: 11/330,144

(22) Filed: Jan. 12, 2006

(65) Prior Publication Data

US 2006/0184159 A1 Aug. 17, 2006

(30) Foreign Application Priority Data

Jan. 19, 2005 (CH) ..... 00078/05

(51) Int. Cl.
*G04B 29/00* (2006.01)

(52) U.S. Cl. ..... 368/319

(58) Field of Classification Search ..... 368/319, 368/320, 306, 288–290, 308
See application file for complete search history.

(56) References Cited

U.S. PATENT DOCUMENTS 3,618,312 A * 11/1971 Macchia et al. ..... 368/289
4,536,095 A * 8/1985 Wuthrich et al. ..... 368/321
5,621,704 A * 4/1997 Baba et al. ..... 368/110
6,146,010 A * 11/2000 Plancon ..... 368/190
7,066,301 B2 * 6/2006 Oh et al. ..... 185/40 R
7,083,325 B2 * 8/2006 Clot et al. ..... 368/190
7,192,184 B2 * 3/2007 Hiranuma et al. ..... 368/319
2003/0206493 A1 * 11/2003 Carrard et al. ..... 368/10

* cited by examiner

*Primary Examiner*—Gary F. Paumen
(74) *Attorney, Agent, or Firm*—Young & Thompson

(57) ABSTRACT

The clockwork movement comprises a crown (12) connected with at least one element of the movement through a connecting organ. It is provided with a selection device (13) that includes a blocking device (15) provided with two blocking spring blades (26, 27) cooperating with a set of teeth (28) of crown (12). This blocking device allows rotation of the crown to be blocked in a first direction, and to be permitted in a second direction, in a predetermined position of a control lever (30) selectively acting on the first or second of these spring blades (26, 27) through a sector (31). When this lever (30) is turned into a second position, rotation of the crown is permitted in the first direction but blocked in the second direction. One thus obtains a movement in which the direction of rotation of crown (12) is selected by the user by his prior action on selection device (13).

13 Claims, 8 Drawing Sheets

Fig.1
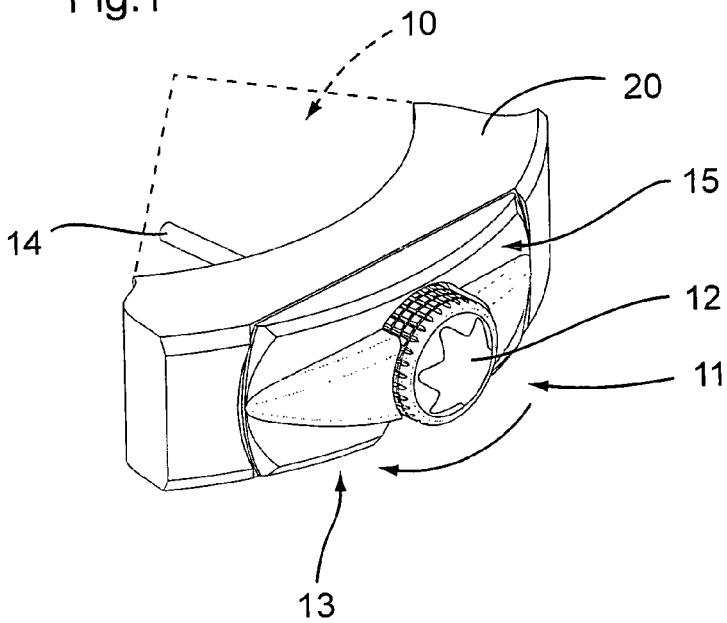
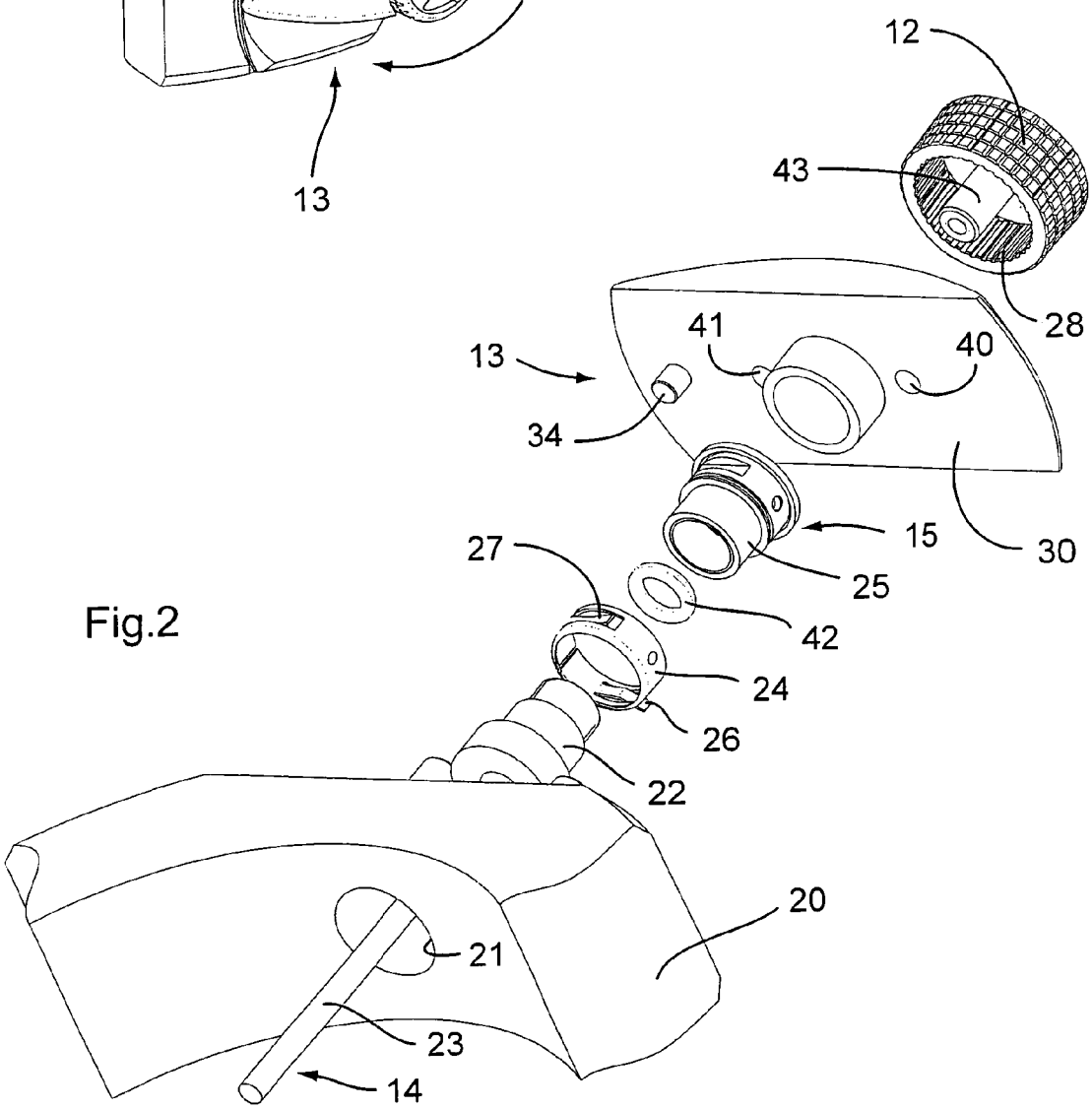
Fig.2

CLOCKWORK MOVEMENT

BACKGROUND OF THE INVENTION

1. Field of the Invention

The present invention relates to a clockwork movement with a rotary organ for an external manual control that is connected by at least one connecting organ to at least one element of the movement and able to be rotated in two opposite directions.

2. Description of the Related Art

Rotary organs of the type just mentioned are well known and most often appear in the shape of a crown that the user can rotate in two opposite directions in order to control one or two functions such as setting time or winding a barrel.

SUMMARY OF THE INVENTION

The present invention has the objective of improving known crowns and enable at least two functions to be controlled in a safe and independent manner with the crown pulled out or not pulled out in the same axial position.

To this effect the movement according to the invention is characterized in that it comprises at least one selection device associated with the rotary organ and so arranged as to occupy at least two different positions, including a first position in which it permits rotation of the connecting organ in a first direction while making impossible a rotation of the connecting organ in the other direction, and a second position in which it makes impossible a rotation of the connecting organ in the first direction but permits rotation of the connecting organ in the other direction.

One thus obtains a movement having a twofold control function with the crown in the same axial position making it possible for instance to control a time zone function when the crown is rotated in the first direction, and a date setting function when the crown is rotated in the other direction. The direction of rotation of the crown is assured inasmuch as the selection device only admits the direction of rotation selected by the user by his prior selection device action.

In a preferred embodiment, the selection device comprises a blocking device that is designed in said first position to block rotation of the rotary organ and of the connecting organ in said other direction, and in said second position to block rotation of the rotary organ and of the connecting organ in said first direction.

One thus obtains a particularly reliable, safely functioning selection device

Favorably, the selection device is designed so as to occupy an additional position in which it makes impossible a rotation of the connecting organ in both directions of rotation.

These characteristics guarantee a very safe separation of the two functions.

Advantageously, the blocking device comprises at least two blocking organs able to cooperate with at least one set of teeth integral with the rotary organ, and at least one control organ, these elements being designed so as to establish or interrupt contact of said teeth with the first or second of the blocking organs.

These characteristics yield a selection device of simple and reliable construction.

According to a preferred embodiment, the two blocking organs consist of a first and second spring blade designed so as to cooperate through their free ends with the teeth so that the first spring blade will bar a rotation of the rotary organ in the second direction while permitting rotation of this rotary organ in the first direction, and that the second spring blade will bar rotation of the rotary organ in the first direction while permitting a rotation of this rotary organ in the second direction, said control organ being provided with at least one part designed to separate the first or second of the spring blades from the teeth, depending on the position of the control organ that a user has selected.

The construction defined by these characteristics requires a small number of components and has reduced space requirements while guaranteeing a reliable function and considerable lifetime.

Highly favorably, the control organ consists of a lever pivotingly mounted around a crown that constitutes said rotary organ, said lever being provided with a projection in the shape of a semicylindrical sector intended to cooperate with the first or second of the spring blades so as to separate them from the teeth, depending on the position of the lever that the user has selected.

These characteristics permit an easy control of the functions while guaranteeing a particular esthetic look.

According to an advantageous variant, the two blocking organs consist of blocking levers slidingly mounted into cylinders, each being solicited by a spring toward a rest position, and each having at least one projection able to cooperate with a set of teeth integral with the rotary organ, these blocking levers being mounted on at least one mobile control part that can be displaced so as to bring the first or second of the blocking levers in contact with said teeth in order to block the rotary organ in the first or second direction of rotation.

This variant yields a very strong solidity of construction and a reliable function.

BRIEF DESCRIPTION OF THE DRAWINGS

Other advantages will become evident from the characteristics expressed in the dependent claims and from the description presenting hereinafter the invention in greater detail with the aid of drawings illustrating schematically and by way of examples four embodiments and variants.

FIG. 1 is a perspective view of the first embodiment.

FIGS. 2 and 3 are exploded perspective views of this first embodiment.

DETAILED DESCRIPTION OF THE INVENTION

Figure 3:
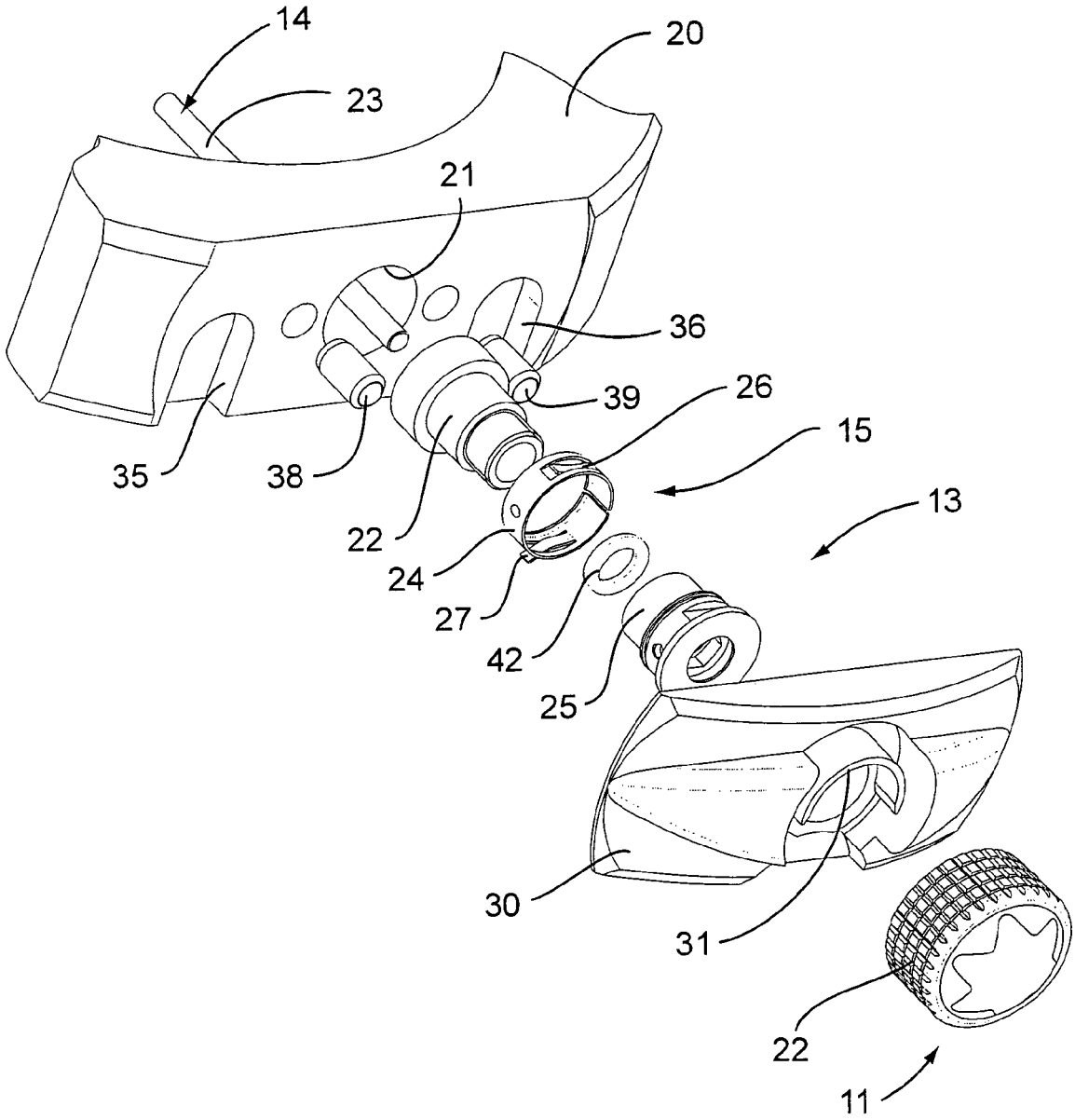

Referring to FIGS. 1 to 6, the first embodiment comprises a movement 10 with a rotary organ 11 such as a crown 12 intended to serve as an external manual control which via at least one connecting organ 14 is connected with at least one element of the movement and can be rotated in two opposite directions. This crown may thus serve as winding organ and/or as an organ to control functions such as setting of the time, time zones, date, lunar phase, repeater, striking mechanism, etc.

The rotary organ 11 is provided with a selection device 13 in order to operate particular functions of the movement, and contains at least one blocking device 15 de-signed so as to occupy at least two different positions including a first position in which it blocks rotation of crown 12 in a first, anticlockwise direction and permits rotation of the rotary organ in a second, clockwise direction, and a second position in which it blocks rotation of the crown in the second, clockwise direction but permits its rotation in the first, counterclockwise direction.

A middle 20 of the movement's case comprises a bore 21 into which a bush 22 is driven and glued.

The bush is traversed by a rod 23 serving as connecting organ 14 that by driving and gluing or screwing has been solidly attached to crown 12.

The blocking device 15 comprises an elastic ring 24 mounted on a support pipe 25 that has been screwed onto the bush 22. Elastic ring 24 has two spring blades 26, 27 projecting from its periphery in order to cooperate with a set of inner teeth 28 of crown 12.

The blocking device 15 is also provided with a control lever 30 mounted pivotably around crown 12 on bush 22 and support pipe 25. This lever 30 has a projection 31 in the shape of a semicylindrical sector situated between the elastic ring 24 and the inner teeth 28 of crown 12. This control lever 30 has a banking 34 intended to cooperate with two hollows 35, 36 provided in middle 20 to limit the rotation of lever 30 to 180°.

Figure 4:
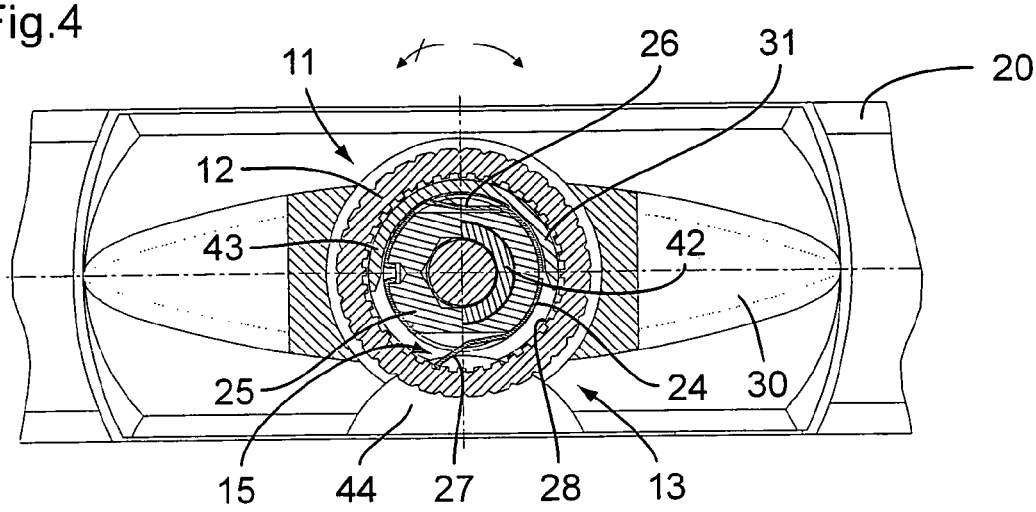
FIGS. 4 and 5 are cross-sectional views along line C-C of FIG. 6 for the first embodiment in two different positions.

In the position illustrated in FIG. 4, projection 31 is situated between spring blade 26 and inner teeth 28 in order to separate this spring blade 26 from the teeth, which will permit a clockwise rotation of crown 12. Spring blade 27 to the contrary, which is oriented in a clockwise direction essentially tangential to elastic ring 24, penetrates between the teeth 28 with its end, in order to bar rotation of crown 12 in the anticlockwise direction of FIG. 4.

Two ball pawls 38, 39 are mounted into middle 20 (FIG. 6) and cooperate with two hollows 40, 41 provided on command lever 30, in order to hold this lever in this position.

Figure 5:
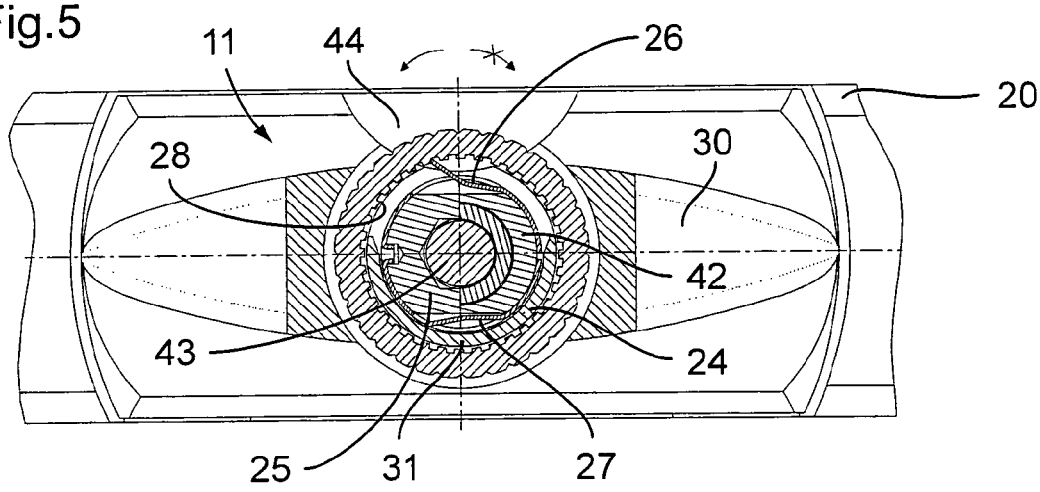
Figure 6:
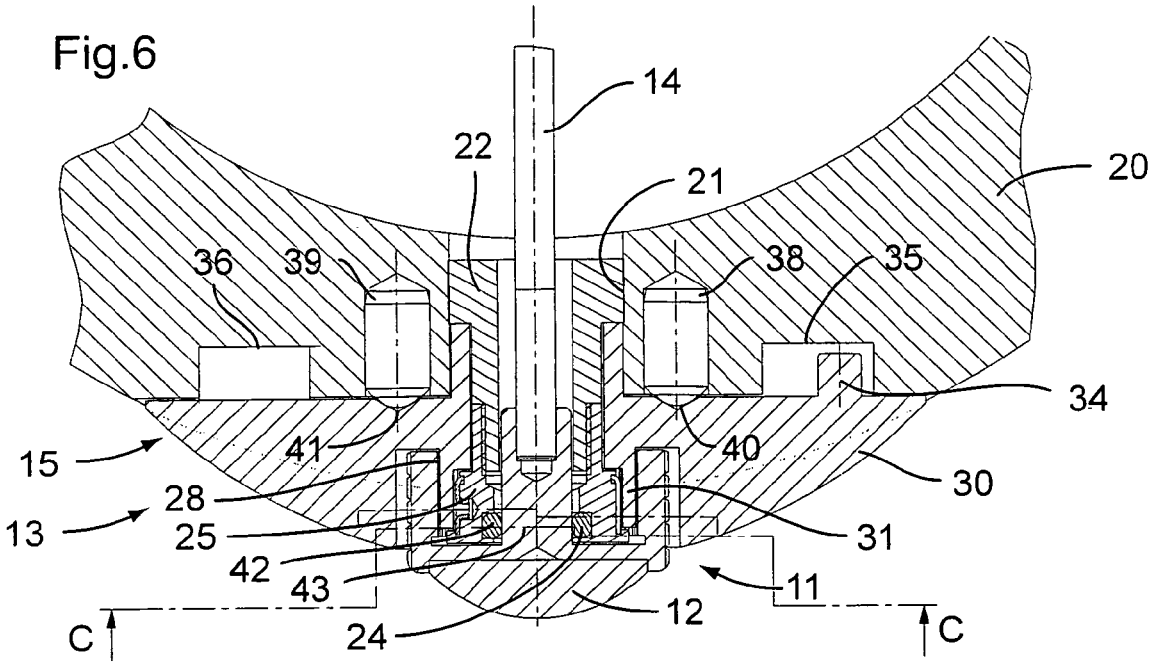
FIG. 6 illustrates a longitudinal section of the first embodiment.
Figure 7:
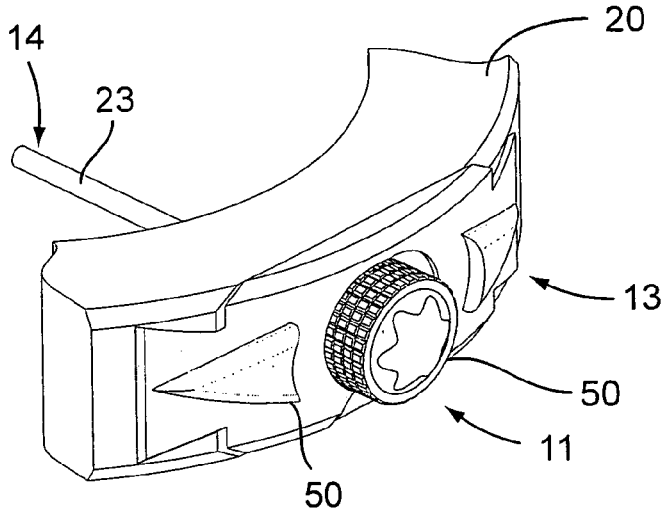
FIG. 7 is a perspective view of the second embodiment.
Figure 8:
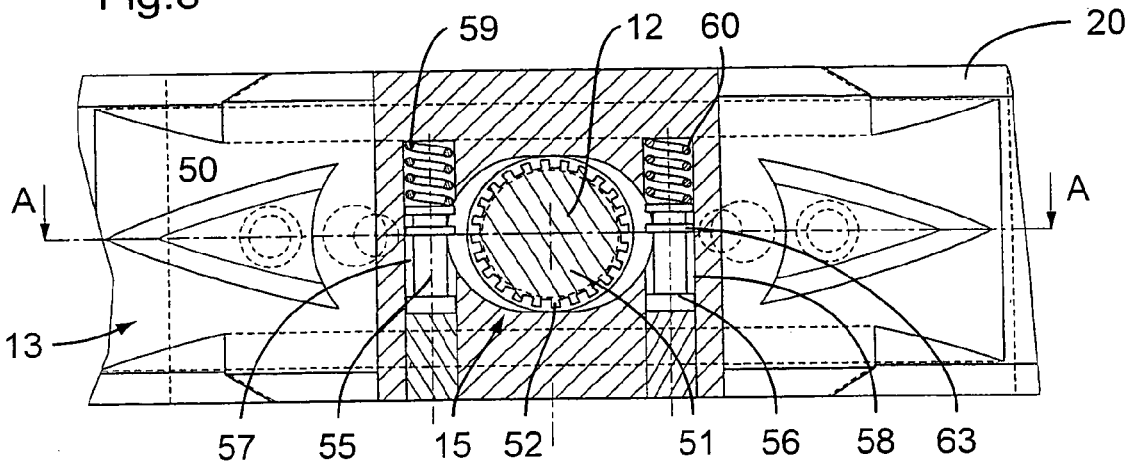
FIGS. 8 and 9 are views in cross section C-C and longitudinal section A-A of the second embodiment in an intermediate position.
Figure 9:
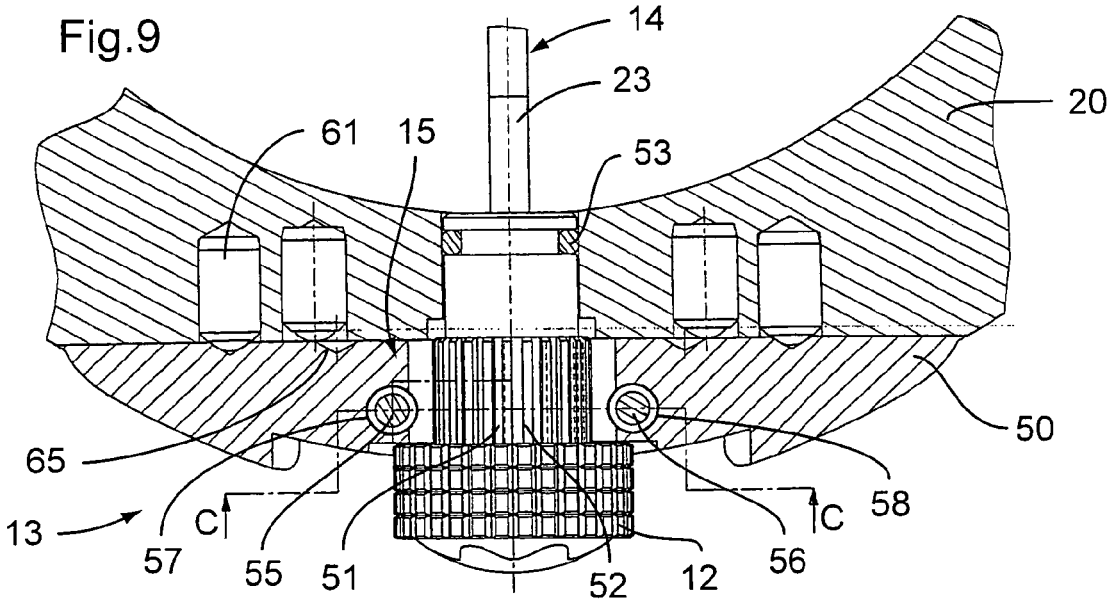
Figure 10:
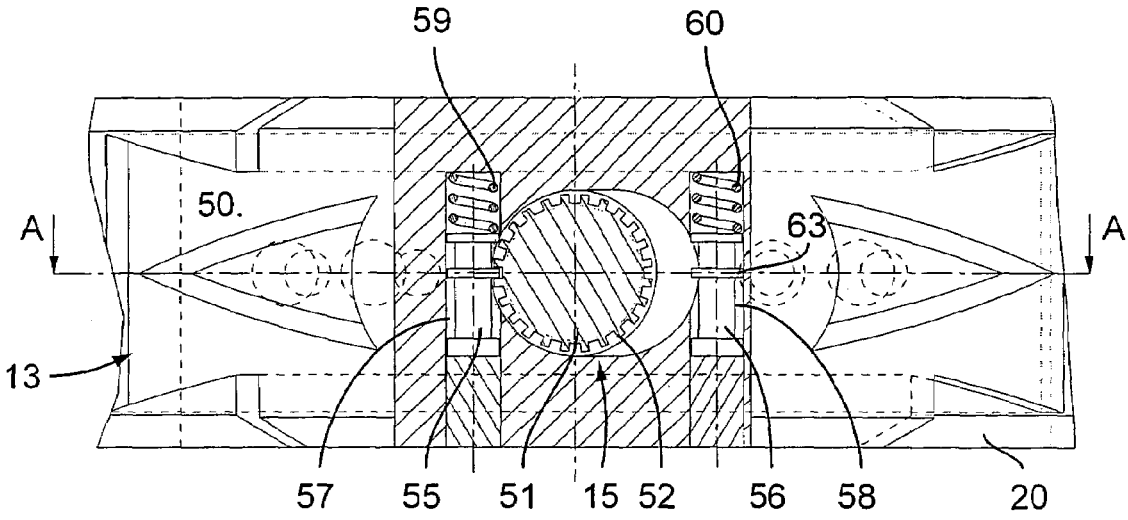
FIGS. 10 and 11 are similar views in cross section C-C and longitudinal section A-A of the second embodiment in another position.

When it is desired to control another function, then the control lever is turned clockwise by 180° (FIGS. 4 and 5) so as to take up a second position as illustrated in FIG. 5.

In this position projection 31 enters between spring blade 27 and the inner teeth 28 in order to permit a rotation of crown 12 in the anticlockwise direction of FIG. 5.

Spring blade 26 which is oriented in a counterclockwise direction essentially tangential to elastic ring 24 penetrates between the teeth 28 with its end in order to bar a clockwise rotation of crown 12. Control lever 30 is once again held in its position by the two ball pawls 38, 39.

In a position of control lever 30 that is intermediate between the positions of FIGS. 4 and 5, projection 31 separates neither spring blade 26 nor spring blade 27 from the teeth, so that crown 12 is blocked in the two directions of rotation.

According to a variant of the preceding embodiment, projection 31 could take up a larger sector, of for instance 210°, so as to be able to separate the two spring blades 26 and 27 from teeth 28 in this intermediate position and allow clockwise and anticlockwise rotations.

The blocking device 15 is provided with a gasket 42 arranged between a central part 43 of crown 12 and the support pipe 25 in order to secure water resistance.

Markings 44 (FIGS. 4 and 5) on lever 30 or middle 20 could make it possible to visualize the direction in which the crown could be rotated by the user, and/or the function that can then be controlled.

Thus, the blocking device 15 notably permits a two-fold function of control with the crown in the same position, pulled out for instance in order to control a time zone function when the crown is rotated in one direction, or a date setting function when the crown is rotated in the other direction.

The selection device and the blocking device are independent of the movement and its functions. They could also be adapted to select among more than two possible functions, by pulling the crown axially into two or more predetermined longitudinal positions.

The second embodiment is illustrated in FIGS. 7 to 11. In this embodiment the selection device 13 also comprises a blocking device 15, but rather than having a pivoted control lever, the blocking device comprises a sliding control part 50 mounted on middle 20 of the movement.

Crown 12 is extended by a cylindrical portion 51 having a set of teeth 52 that is connected with a connecting rod 23. A gasket 53 guarantees water resistance of the crown.

The control part 50 is provided with two blocking levers 55, 56 slidingly mounted into cylinders 57, 58 on both sides of cylindrical portion 51.

These two blocking levers are solicited by helical springs 59, 60 to rest positions, and have each an annular rib 63 that is able to cooperate with the teeth 52. When control part 50 is shifted to the right (FIG. 10), the blocking lever 55 engages into teeth 52 with its rib 63. When it is attempted to rotate crown 12 in an anticlockwise direction, then all rotary motions are blocked. A clockwise rotation to the contrary is possible, since the blocking lever can move against the action of spring 59.

In the left-hand position of control part 50, rib 63 of right-hand blocking lever 56 is engaged with the teeth 52 so as to block a clockwise rotation but permit an anticlockwise rotation against the action of spring 60.

In an intermediate position of control part 50 (FIG. 8), neither of the blocking levers 55, 56 is in contact with the teeth 52, and the crown can be rotated in the two directions.

Figure 11:
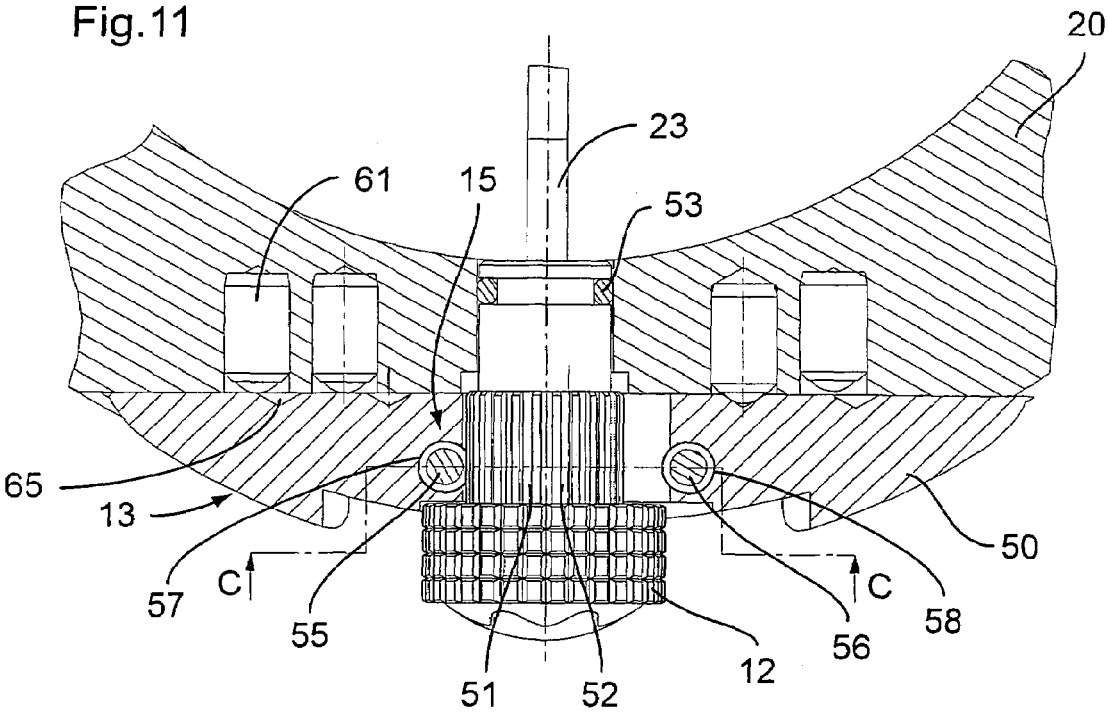
Figure 12:
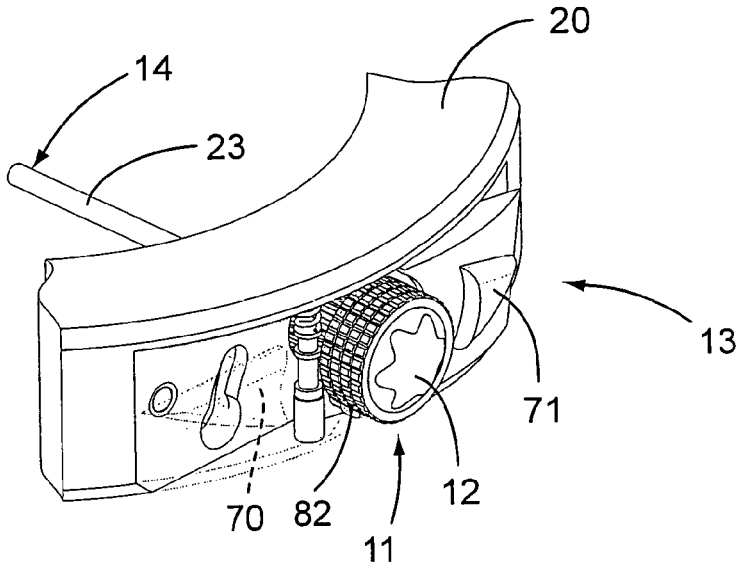
FIG. 12 is a perspective view of the third embodiment.
Figure 13:
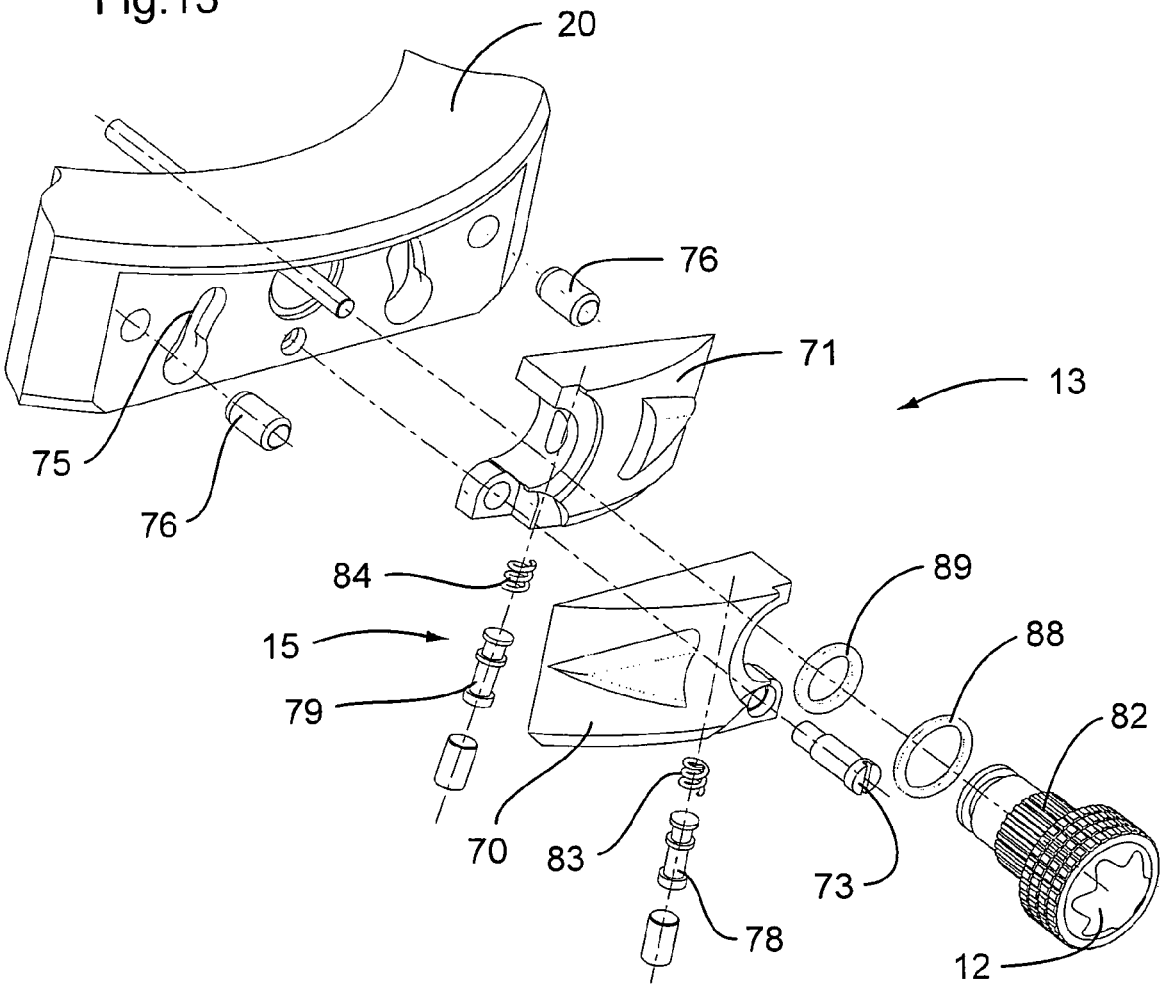
FIG. 13 represents an exploded perspective view of this third embodiment.

The selection device 13 further comprises four ball pawls 61 mounted into middle 20 that can cooperate with four hollows 65 provided in control part 50, so as to hold this control part in the intermediate position (FIG. 9) or in the first or second of the blocking positions (FIG. 11).

In the third embodiment illustrated in FIGS. 12 to 15, selection device 13 has a blocking device 15 with two control levers 70, 71 pivotingly attached to middle 20 with a screw 73 serving as pivoting axis. Each of the levers is provided with a slide block 74 cooperating with a slide bar 75 (FIG. 15) into which it is introduced. Two ball pawls 76 are mounted into middle 20 and cooperate with hollows 77 provided on the levers in order to hold these levers in a rest position.

Two annular gaskets 88, 89 yield good water resistance of the crown.

Each lever 70, 71 further comprises a blocking lever 78, 79 slidingly mounted into cylinders 80, 81 provided in the levers on both sides of crown 12 that is provided with a set of outer teeth 82. The two blocking levers are solicited by helical springs 83, 84 toward a rest position, and each of them has an annular rib 86 able to cooperate with the outer teeth 82 of the crown.

When the two levers 70, 71 are in their rest positions, the two blocking levers 78, 79 will be engaged in the outer teeth 82, and the crown is blocked in both directions of rotation.

Figure 14:
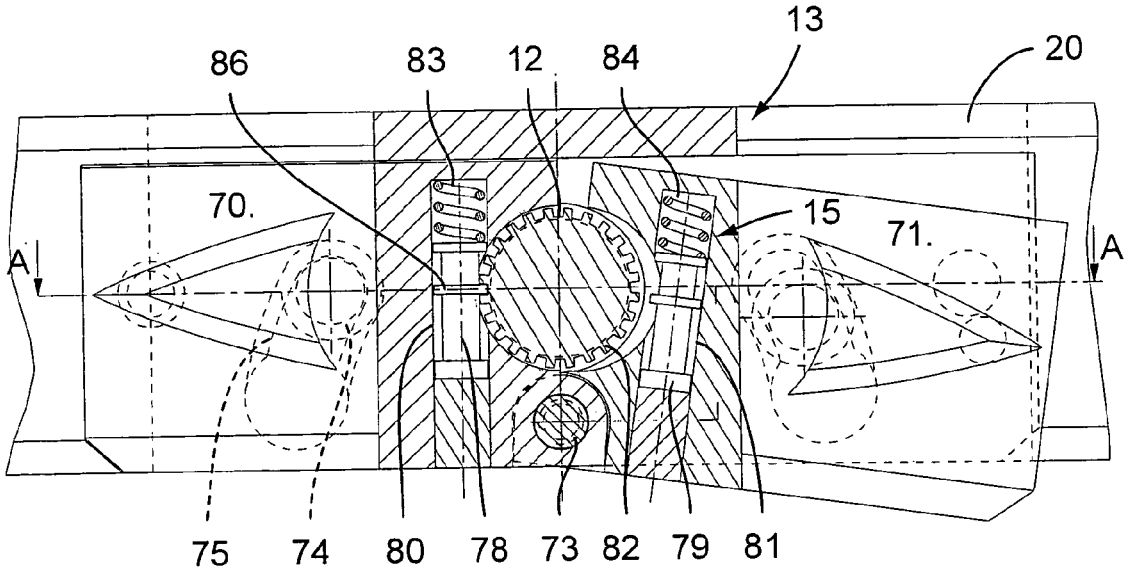
FIGS. 14 and 15 are views in cross section C-C and longitudinal section A-A through the third embodiment.
Figure 15:
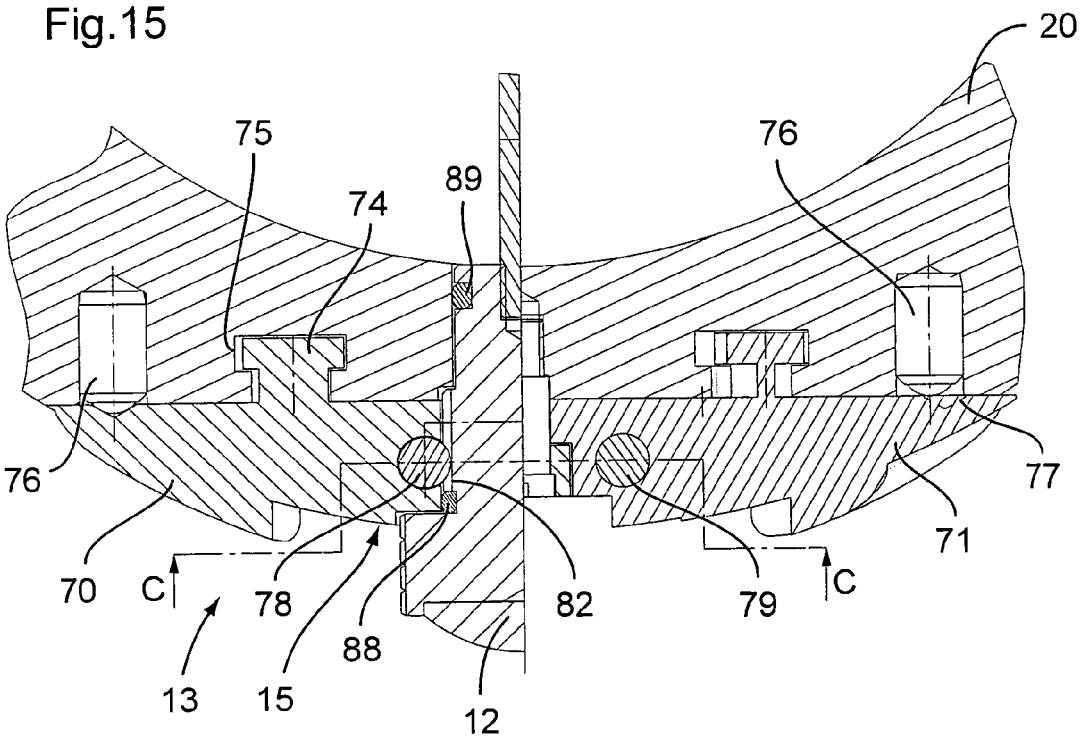

When the right-hand lever 71 (FIG. 14) or the left-hand lever is pivoted, crown 12 can then be rotated clockwise or anticlockwise, respectively. When one of the levers 70, 71 is pivoted, the other lever will be brought to its rest position. For example, when lever 70 in FIG. 14 is pivoted, then lever 71 is brought back to its rest position while its blocking lever 79 is engaged with crown 12.

It is equally possible, of course, to configure the swivel attachments of levers 70, 71 around screw 73 in such a way that the two blocking levers 78, 79 of the two levers 70, 71 could be separated from crown 12 and the latter could be rotated in the two directions of rotation.

Figure 16:
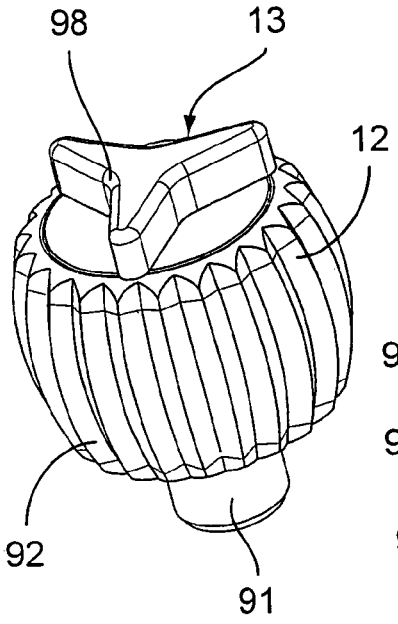
FIGS. 16, 17 and 18 are views in perspective, in longitudinal section A-A and in cross section C-C of a fourth embodiment.
Figure 17:
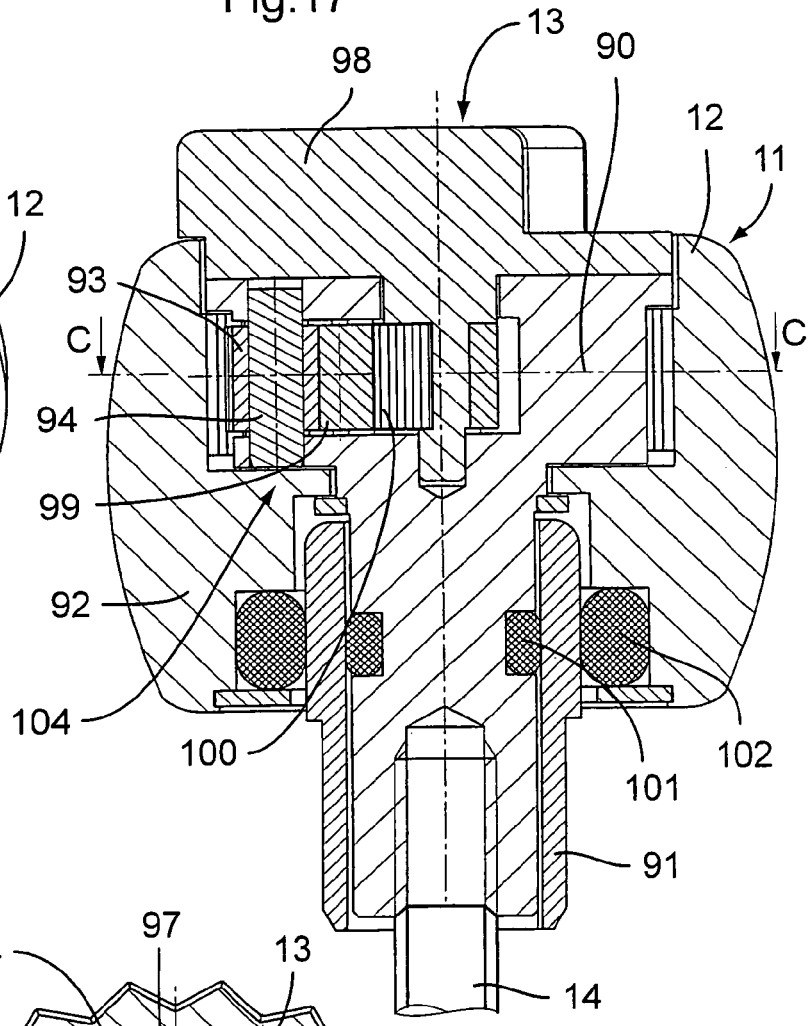
Figure 18:
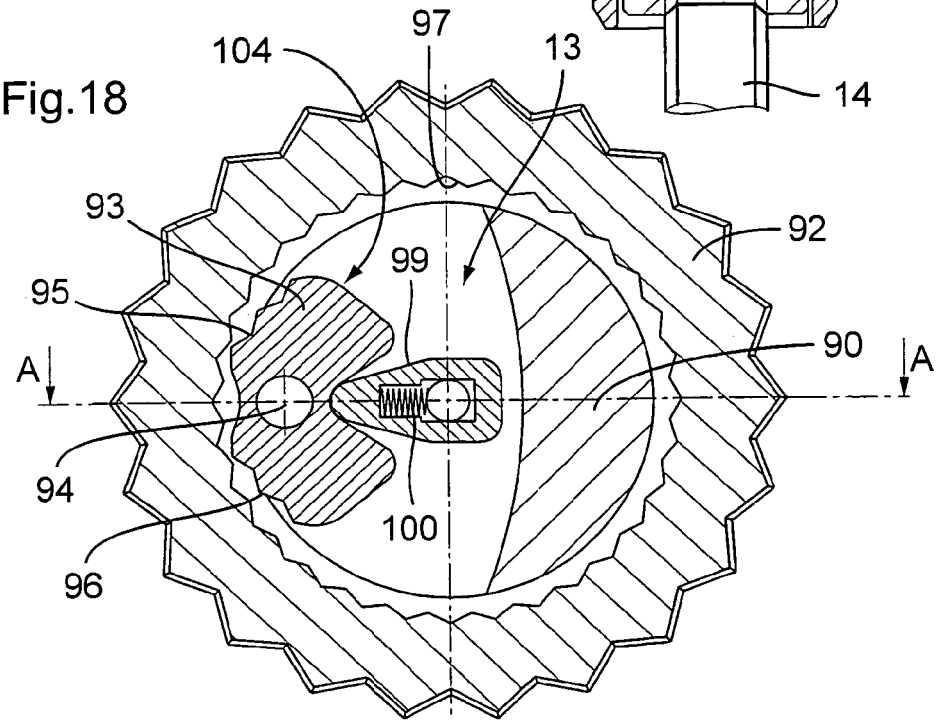

The fourth embodiment is illustrated in FIGS. 16 to 18. It has a selection device 13 that is integrated into crown 12. The latter comprises an inner crown 90 solidly connected with a connecting organ 14 connected with at least one element of the movement.

This inner crown 90 is mounted rotatably into a pipe 91 driven into a bore of the middle.

The crown further comprises an outer crown 92 that can be operated manually by the user. This outer crown is connected with the inner part by selection device 13, which has a coupling mechanism 104. The latter has a latch 93 pivoted around an axis 94, and including right-hand teeth 95 as well as left-hand teeth 96 intended to selectively cooperate with a set of inner teeth 97 of outer crown 92 (FIG. 18).

A control part 98 is pivoted on the inner crown 90 and has an operating finger 99 solicited toward latch 93 by a spring 100.

When this finger 93 is rotated clockwise, the right-hand teeth 95 (FIG. 18) are solicited toward the inner teeth 97 of outer crown 92. During an anticlockwise rotation of the latter, its inner teeth 97 will be engaged with the right-hand teeth 95 and will rotate the inner crown 90 as well as the connecting organ 14.

During a clockwise rotation, to the contrary, the inner teeth 97 slip over the right-hand teeth 95, hence neither the inner crown nor the connecting organ 14 will be rotated.

When, to the contrary, the control part 98 and the operating finger 99 are rotated counterclockwise (FIG. 18), then the left-hand teeth 96 will be engaged with the inner teeth 97 so as to permit clockwise rotation of inner crown 90 by outer crown 92 that had become locked, and to unlock the outer from the inner crown during an anticlockwise rotation of outer crown 92.

Two gaskets 101 and 102 arranged between pipe 91 and the inner or outer crown, respectively, guarantee water tightness of crown 12.

It is understood that the embodiments described above are not in any way limiting, and may receive all modifications that could be desirable within the scope defined by claim 1. The blocking devices described could more particularly be of different design.

The crown could take up several axial positions, and hence control twice as many functions.

The levers and other control parts could have a different shape.

The movement could have several rotary control organs, each provided with a selection device.

The invention claimed is:

1. A clockwork movement having a rotary organ for an external manual control that is connected via at least one connecting organ to at least one element of movement, and can be rotated in two opposite directions, comprising:

at least one selection device associated with the rotary organ and designed so as to take up at least two different positions including a first position in which the selection device permits rotation of the connecting organ in a first direction but makes impossible the rotation of the connecting organ in a second direction, and a second position in which the selection device makes impossible the rotation of the connecting organ in the first direction but permits rotation of the connecting organ in the second direction.

2. The movement according to claim 1, wherein the selection device comprises a blocking device designed so as to block in said first position the rotation of the rotary organ and of the connecting organ in said second direction, and to block in said second position the rotation of the rotary organ and of the connecting organ in said first direction.

3. The movement according to claim 1, wherein the selection device is designed so as to take up an additional position in which the selection device makes impossible a rotation of the connecting organ in both directions of rotation.

4. The movement according to claim 2, wherein the selection device is designed so as to take up an additional position in which the selection device makes impossible a rotation of the connecting organ in both directions of rotation.

5. The movement according to claim 1, wherein the selection device is designed so as to take up another position in which the selection device permits a rotation of the connecting organ in both directions of rotation.

6. The movement according to claim 2, wherein the blocking device comprises at least two blocking organs that are able to cooperate with at least one set of teeth integral with the rotary organ, and at least one control organ designed so as to establish or break the contact between said teeth and one or the other of the blocking organs.

7. The movement according to claim 6, wherein the two blocking organs comprise a first and a second spring blade designed so as to cooperate via their free ends with teeth in such a way that the first spring blade will bar a rotation of the rotary organ in the second direction and permit a rotation of this rotary organ in the first direction, and that the second spring blade will bar a rotation of the rotary organ in the first direction and permit a rotation of this rotary organ in the second direction, said control organ being provided with at least one part designed so as to separate the first or second of the spring blades from the teeth, depending on the position of the control organ selected by a user.

8. The movement according to claim 7, wherein the control organ comprises a lever mounted rotatably around a crown constituting said rotary organ, said lever being provided with a projection in the shape of a semicylindrical sector that is intended to cooperate with the first or second of the spring blades so as to separate them from the teeth, depending on the position of the lever selected by the user.

9. The movement according to claim 6, wherein the two blocking organs comprise blocking levers slidingly mounted into cylinders, each of the blocking levers solicited by a spring toward a rest position and each blocking lever including at least one projection able to cooperate with a set of teeth integral with the rotary organ, the blocking levers being mounted on at least one mobile control part that can be displaced so as to bring one or the other of the blocking levers in contact with said teeth in order to block the rotary organ in the first or second direction of rotation.

10. The movement according to claim 9, wherein the control part comprises a sliding part mounted around the rotary organ and holding the two blocking levers situated on the two sides of the teeth of the rotary organ, the first or second of the blocking levers being able to be solicited against said teeth by translation of the sliding part.

11. The movement according to claim 9, wherein each of the blocking levers is mounted on a control part that is pivoted close to the rotary organ so as to be separated from or brought in contact with said teeth.

12. The movement according to claim 1, wherein the rotary organ comprises an inner crown integral with the connecting organ and an outer crown that can be connected to the inner crown via a coupling mechanism, this coupling mechanism being designed so as to cause the two crowns to be locked together in the first or second direction of rotation, depending on the position taken up by a control part acting on the coupling mechanism.

13. The movement according to claim 12, wherein the coupling mechanism comprises a pivoting latch that includes two sets of teeth, one or the other of the sets of teeth being able to cooperate with a set of teeth of the outer crown, depending on the position of the control part that acts on the pivoting latch through a finger.

* * * * *

UNITED STATES PATENT AND TRADEMARK OFFICE

CERTIFICATE OF CORRECTION

PATENT NO. : 7,404,669 B2
APPLICATION NO. : 11/330144
DATED : July 29, 2008
INVENTOR(S) : Bruno Marie Marc Lambert It is certified that error appears in the above-identified patent and that said Letters Patent is hereby corrected as shown below:

On the Title Page, Item (73) Assignee should read
--(73) Assignee: Montblanc-Simplo GmbH, Hamburg (DE)--

Signed and Sealed this

Sixteenth Day of September, 2008

JON W. DUDAS
*Director of the United States Patent and Trademark Office*